US006666452B1

(12) United States Patent
Kielar

(10) Patent No.: US 6,666,452 B1
(45) Date of Patent: Dec. 23, 2003

(54) SPINNER GAME AND METHOD OF PLAYING THE SAME

(76) Inventor: Michael F. Kielar, 11709 Broken Arrow Dr., Conifer, CO (US) 80433-6920

( * ) Notice: Subject to any disclaimer, the term of this patent is extended or adjusted under 35 U.S.C. 154(b) by 0 days.

(21) Appl. No.: 10/122,363

(22) Filed: Apr. 15, 2002

(51) Int. Cl.[7] ..... A63B 71/00
(52) U.S. Cl. ..... 273/138.1; 273/139; 273/142 JB
(58) Field of Search ..... 273/138.1, 139, 273/142 JB, 138.2, 443, 449, 456, 459, 441, 445–6; 446/132, 139, 227–29, 232–35, 237–30, 236; 223/85, 92

(56) References Cited

U.S. PATENT DOCUMENTS 2,684,850 A * 7/1954 Williams ..... 473/576
4,022,474 A * 5/1977 Breslow et al. ..... 273/138.2
4,043,554 A * 8/1977 Wolf ..... 273/459
4,358,110 A * 11/1982 Youkstetter ..... 273/450
4,630,822 A * 12/1986 Massaglia ..... 273/118 A
5,078,386 A * 1/1992 Hou et al. ..... 472/7
6,454,261 B2 * 9/2002 Ohira ..... 273/140

* cited by examiner

*Primary Examiner*—Benjamin H. Layno
*Assistant Examiner*—V K Mendiratta

(57) ABSTRACT

A spinner game and the method of playing the same for providing a fun-filled game which gives an advantage to a player having a high degree of coordination. The spinner game and the method of playing the same includes a tree-like structure having a base member, an elongate trunk member being attached to the base member and extending upwardly therefrom, and branch members extending outwardly from the elongate trunk member; and also includes an assembly of playing the spinner game including a plurality of spinner members being spinably and detachably attached to the branch members, and also including die members.

4 Claims, 5 Drawing Sheets

SPINNER GAME AND METHOD OF PLAYING THE SAME

BACKGROUND OF THE INVENTION

1. Field of the Invention

The present invention relates to spinning games and more particularly pertains to a new spinner game and the method of playing the same for providing a fun-filled game which gives an advantage to a player having a high degree of coordination.

2. Description of the Prior Art

The use of spinning games is known in the prior art. More specifically, spinning games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,060,947; U.S. Pat. No. 4,690,657; U.S. Pat. No. 5,250,659; U.S. Pat. No. 4,043,554; U.S. Pat. No. 4,221,385; and U.S. Pat. No. Des. 272,836.

While these devices fulfill their respective, particular objectives and requirements, the aforementioned patents do not disclose a new spinner game and the method of playing the same. The prior art includes inventions having pendulum games with magnets and other games.

SUMMARY OF THE INVENTION

The general purpose of the present invention, which will be described subsequently in greater detail, is to provide a new spinner game and the method of playing the same which has many of the advantages of the spinning games mentioned heretofore and many novel features that result in a new spinner game and the method of playing the same which is not anticipated, rendered obvious, suggested, or even implied by any of the prior art spinning games, either alone or in any combination thereof. The present invention includes a tree-like structure having a base member, an elongate trunk member being attached to the base member and extending upwardly therefrom, and branch members extending outwardly from the elongate trunk member; and also includes an assembly of playing the spinner game including a plurality of spinner members being spinably and detachably attached to the branch members, and also including die members. None of the prior art includes spinner members which are magnetically-attached to branch members and which are spun therefrom to score points.

There has thus been outlined, rather broadly, the more important features of the spinner game and the method of playing the same in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new spinner game and the method of playing the same which has many of the advantages of the spinning games mentioned heretofore and many novel features that result in a new spinner game and the method of playing the same which is not anticipated, rendered obvious, suggested, or even implied by any of the prior art spinning games, either alone or in any combination thereof.

Still another object of the present invention is to provide a new spinner game and the method of playing the same for providing a fun-filled game which gives an advantage to a player having a high degree of coordination.

Still yet another object off the present invention is to provide a new spinner game and the method of playing the same that is easy and convenient to set up.

Even still another object of the present invention is to provide a new spinner game and the method of playing the same that signals out those players having a high degree of quickness and coordination to effectively play the game well.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
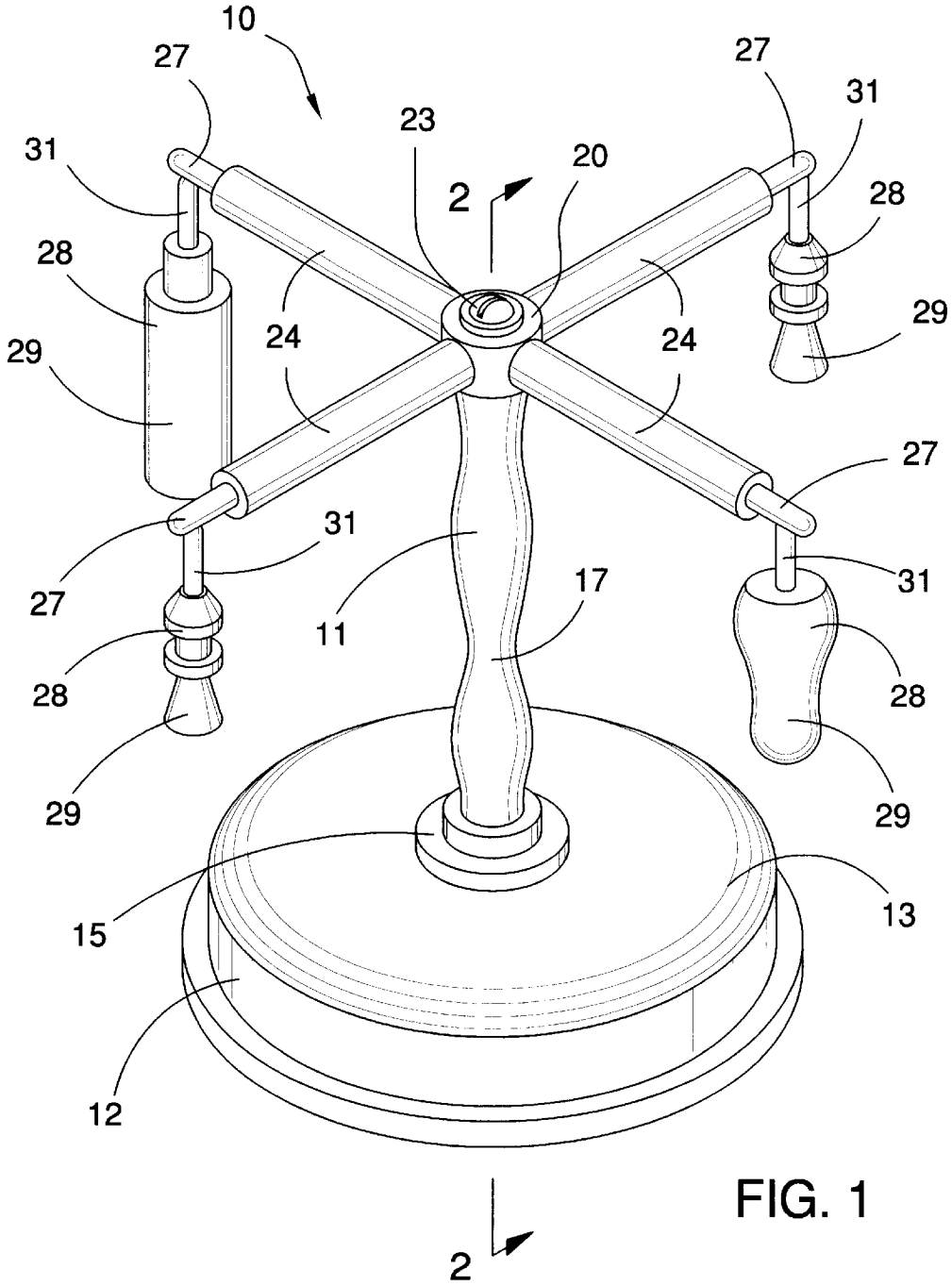
FIG. 1 is a perspective view of a new spinner game and the method of playing the same according to the present invention and shown in use.
Figure 2:
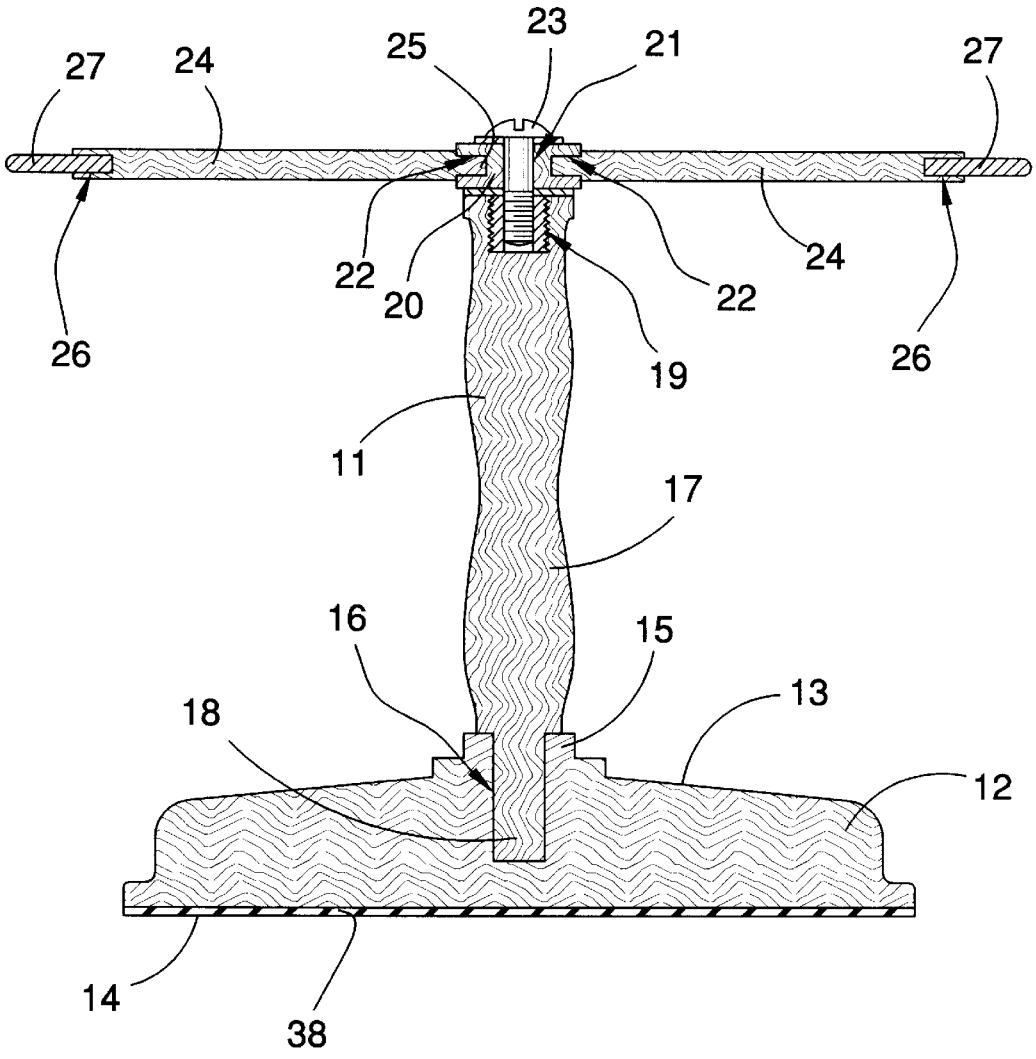
FIG. 2 is a cross-sectional view of the spinner support member of the present invention.
Figure 3:
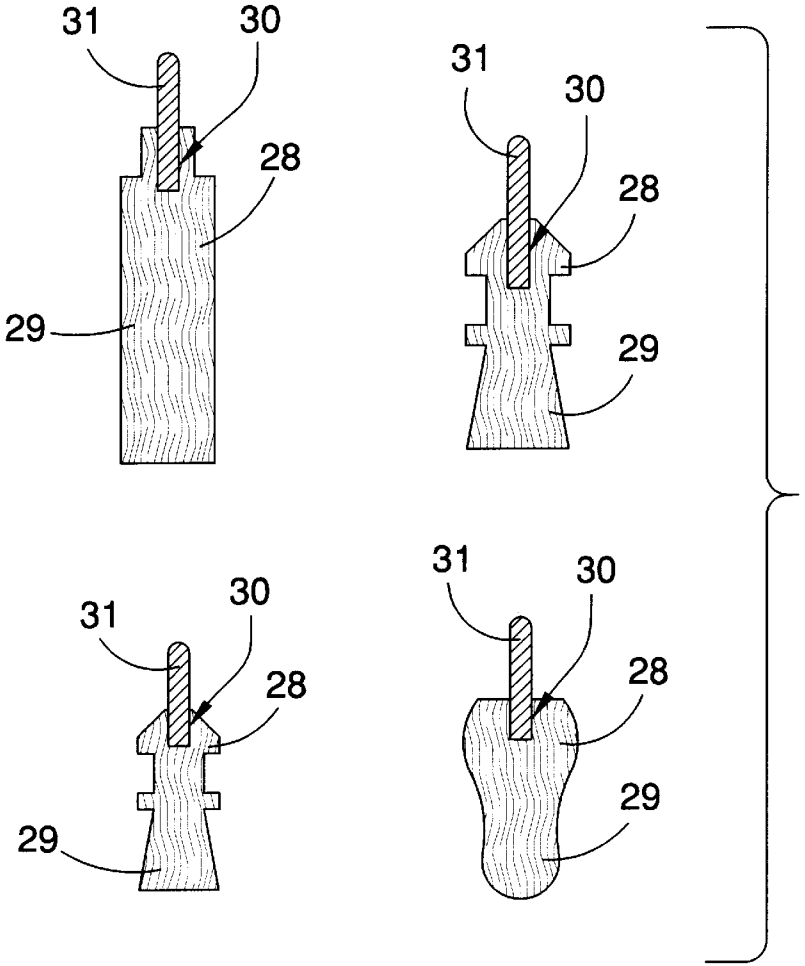
FIG. 3 is a cross-sectional view of the spinner members of the present invention.
Figure 4:
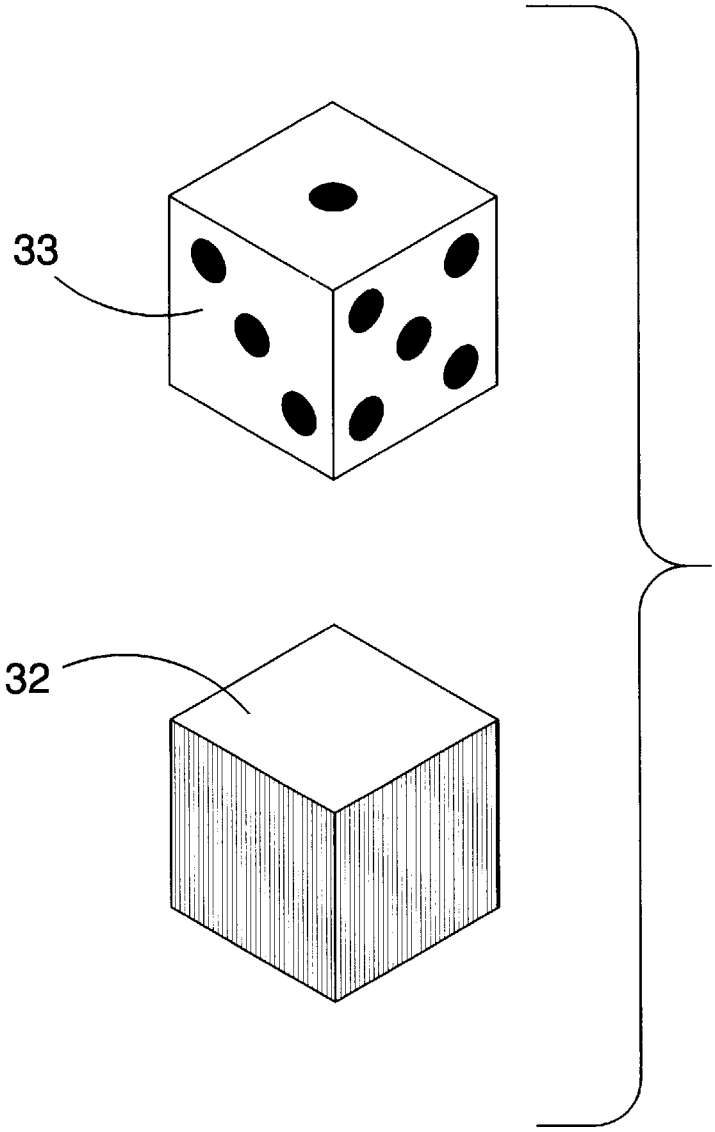
FIG. 4 is a perspective view of the die of the present invention.
Figure 5:
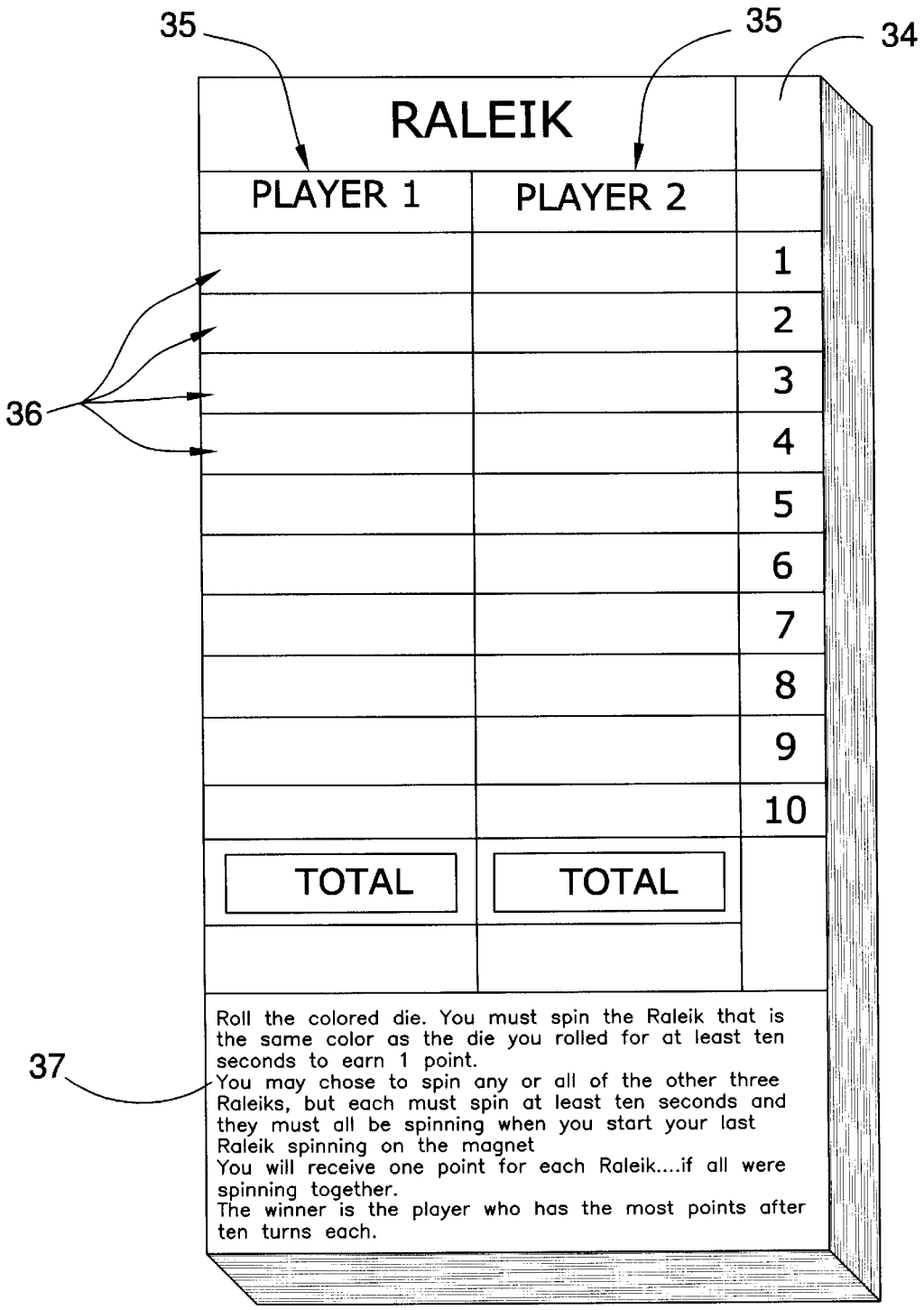
FIG. 5 is a perspective view of the score sheet of the present invention.

With reference now to the drawings, and in particular to FIGS. 1 through 5 thereof, a new spinner game and the method of playing the same embodying the principles and concepts of the present invention and generally designated by the reference numeral 10 will be described.

As best illustrated in FIGS. 1 through 5, the spinner game and the method of playing the same 10 generally comprises a tree-like structure 11 having a base member 12, an elongate trunk member 17 being conventionally attached to the base member 12 and extending upwardly therefrom, and branch members 24 extending outwardly from the elongate trunk member 17. The base member 12 includes top and bottom sides 13, 14, and also includes a boss 15 being centrally and integrally disposed upon the top side 13 thereof, and further includes a bore 16 being disposed through the boss 15 and into the base member 12. The tree-like structure 11 further includes a non-slip pad member 38 being securely and conventionally attached to the bottom side 14 of the base member 12 to prevent the base member 12 from slipping upon a surface. The base member 12 is generally disc-shaped. The elongate trunk member 17 includes a dowel-like extension 18 being conventionally disposed at a bottom end thereof and being securely disposed in the bore 16 in the base member 12 to substantially stabilize the elongate trunk member 17 upon the base member 12. The elongate trunk member 17 also has a threaded slot 19 being disposed in a top end thereof. The tree-like structure 11 also includes a branch support member 20 being fastened with a threaded fastener 23 to the top end of the elongate trunk member 17, and also being generally disc-shaped, and having a bore 21 extending axially therethrough from a top to a bottom thereof, and further having radial slots 22 extending in a circumference thereof and being circumferentially-spaced with the threaded fastener 23 being threaded into the threaded slot 19 of the elongate trunk member 17. The branch members 24 are securely and conventionally disposed in the radial slots 22 of the branch support member 20 with each of the branch members 24 having a dowel-like member 25 extending from a first end thereof and being securely and conventionally disposed and engaged in a respective one of the radial slots 22. Each of the branch members 24 also has a slot 26 being disposed in a second end thereof. The tree-like structure 11 also includes a plurality of spinner support members 27 being securely and conventionally disposed in and extended outwardly of the slots 26 of the branch members 24 with each of the spinner support members 27 being generally dowel-shaped.

A means of playing the spinner game including a plurality of spinner members 28 being spinably and magnetically attached to the branch members 24, and also including die members 32,33. Each of the spinner members 28 includes a uniquely-shaped body 29 and also includes a pin member 31 being conventionally attached to the uniquely-shaped body 29 and being spinably and magnetically-attached to and depended from a respective one of the spinner support members 27. Each of the uniquely-shaped bodies 29 has a bore 30 extending therein through a top thereof with the pin members 31 being securely disposed in and extended outwardly from the bores 30 of the uniquely-shaped bodies 29. Each of the pin members 31 is metallic. The die members 32,33 includes a first die member 33 having dots being disposed upon sides thereof, and also includes a second die member 32 having sides which are uniquely colored. The means of playing the spinner game also includes one or more score sheets 34 having rules of the spinner game 37 being conventionally displayed thereon and also having lines arranged to form columns 35 and rows 36 which are further divided into sections upon which points scored in the spinner game are recorded.

In use, the players roll the uniquely-colored die member 32 with the side of the die member 32 facing upwardly upon the surface determining which of the spinner members 28 should be spun as it depends from a respective branch member 24, and the players then spin the designated spinner member 28 having the same color as that of the upwardly facing side of the die member 32 and also spin as many of the other the spinner members 28 as desired without any of them falling off the spinner support member 27. The players score one point for each of the spinner members 28 which remains spinning upon the spinner support member 27 for at least 10 seconds. The players continue to take turns and roll the die member 32 and spin one or more of the spinner members 28 until one of the players wins by having the highest total score.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the spinner game and the method of playing the same. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a spinner game includes the steps of:

providing a tree-like structure having branch members and spinner support members extending from ends of the branch members, and also having spinner members which are magnetically-attachable to said spinner support members and which are uniquely colored, and further having die members and score sheets with one of said die members having sides which are uniquely colored;

rolling one of said die members to determine which of said spinner members should be spun as it depends from a respective said branch member;

spinning the designated said spinner member and as many of the other said spinner members as desired without any of them falling off the spinner support member;

scoring points for said spinner members which remain spinning upon said spinner support members for at least 10 seconds; and repeating said steps of rolling one of said die members, and spinning the designated said spinner member and as many of the other spinner member, and scoring points for said spinner members for all players until one of the players wins.

2. A method of playing the spinner game as described in claim 1, wherein the step of rolling one of said die members includes the step of rolling said uniquely colored die member with the uniquely colored side facing upwardly determining which of said spinner members should be spun.

3. A method of playing the spinner game as described in claim 2, wherein the step of spinning the designated spinner member includes the step of spinning the spinner member having the same color as that of the upwardly facing side of said uniquely colored die member.

4. A method of playing the spinner game as described in claim 3, wherein the step of scoring points includes the step of awarding one point for each of said spinner members which spins from a respective said spinner support member for at least 10 seconds.

* * * * *